US010172473B1

(12) United States Patent
Segraves

(10) Patent No.: US 10,172,473 B1
(45) Date of Patent: Jan. 8, 2019

(54) BODY PILLOW

(71) Applicant: Sherry Segraves, Benedict, KS (US)

(72) Inventor: Sherry Segraves, Benedict, KS (US)

( * ) Notice: Subject to any disclaimer, the term of this patent is extended or adjusted under 35 U.S.C. 154(b) by 0 days.

(21) Appl. No.: 15/225,997

(22) Filed: Aug. 2, 2016

(51) Int. Cl.
*A47C 27/08* (2006.01)
*A47G 9/10* (2006.01)
*A47C 20/02* (2006.01)

(52) U.S. Cl.
CPC ..... *A47C 27/086* (2013.01); *A47C 20/02* (2013.01); *A47G 9/10* (2013.01); *A47G 2009/1018* (2013.01)

(58) Field of Classification Search
CPC ..... A47C 7/383; A47C 20/02; A47C 20/027; A47C 7/021; A47C 7/38; A47G 2009/1018; A47G 9/10; A47G 9/1045; A47G 9/1072; A47G 9/109; A61G 7/065
See application file for complete search history.

(56) References Cited

U.S. PATENT DOCUMENTS 74,340 A * 2/1868 Gllbert ..... A47C 27/086 297/DIG. 2
765,519 A * 7/1904 Sperry ..... A47G 9/10 428/6
2,147,362 A * 2/1939 Bloomberg ..... A47C 27/086 162/170
2,932,833 A * 4/1960 Wambach ..... A47G 9/1045 135/133
3,373,455 A 3/1968 Kaplan
3,681,796 A 8/1972 Watson
3,900,648 A * 8/1975 Smith ..... A47C 27/22 428/317.9
4,011,611 A * 3/1977 Lederman ..... A47C 3/16 273/DIG. 2
4,287,621 A * 9/1981 Kertz ..... B60N 3/00 224/276
4,432,110 A * 2/1984 Sutton ..... A47C 7/18 297/DIG. 1
D284,436 S * 7/1986 Hodges ..... D6/596
4,754,510 A 7/1988 King
4,862,539 A * 9/1989 Bokich ..... A47C 27/086 297/219.1
D307,369 S 4/1990 Zollinger
5,079,787 A * 1/1992 Pollmann ..... A47C 27/086 206/584
5,228,158 A * 7/1993 Park ..... A47G 9/10 5/636
7,089,614 B1 8/2006 Clapp
(Continued)

FOREIGN PATENT DOCUMENTS

CA 2288168 A1 3/2012
JP 2012254231 A * 12/2012 ..... A47C 27/086

*Primary Examiner* — Eric J Kurilla

(57) ABSTRACT

The body pillow is a pillow that is adapted to facilitate sleeping in a variety of positions. The body pillow comprises a batting, a plurality of pellets and a containment. The batting and the plurality of pellets are contained within the containment. The batting is formed from a first soft material that provides the core cushioning structure of the body pillow. Each of the plurality of pellets is made from a second soft material that is formed in the structure of a pellet. When a body is placed upon the plurality of pellets, as contained within the container, the location of each of the plurality of pellets will shift into a position that provides a contoured support customized to the body.

9 Claims, 3 Drawing Sheets

(56) References Cited

U.S. PATENT DOCUMENTS

| | | | | |
|---|---|---|---|---|
| D527,937 | S | 9/2006 | Aiken | |
| 7,322,061 | B2 | 1/2008 | Carroll | |
| 9,375,091 | B1 * | 6/2016 | Baker | A47C 7/383 |
| 2008/0184490 | A1 * | 8/2008 | Brogan | A47G 9/10 5/645 |
| 2012/0036640 | A1 * | 2/2012 | Kim | A47G 9/007 5/636 |
| 2013/0255000 | A1 * | 10/2013 | Kavovit | A47G 9/10 5/639 |
| 2014/0230152 | A1 * | 8/2014 | Wootten, Jr. | A47G 9/10 5/645 |
| 2014/0345055 | A1 * | 11/2014 | Li | A47G 9/1027 5/630 |
| 2015/0196851 | A1 * | 7/2015 | Myers | A47G 9/1045 446/80 |
| 2015/0327697 | A1 * | 11/2015 | Joseph | A47G 9/10 5/636 |
| 2016/0316929 | A1 * | 11/2016 | Danielson | A47G 9/1036 |

* cited by examiner

BODY PILLOW

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of domestic articles and bedding, more specifically, a pillow.

SUMMARY OF INVENTION

The body pillow is a pillow that is adapted to facilitate sleeping in a variety of positions. The body pillow comprises a batting, a plurality of pellets and a containment. The batting and the plurality of pellets are contained within the containment. The batting is formed from a first soft material that provides the core cushioning structure of the body pillow. Each of the plurality of pellets is made from a second soft material that is formed in the structure of a pellet. The totality of the plurality of pellets act very much like a liquid in the sense that, in their totality, the plurality of pellets does not have a shape but instead takes the shape of the container within which the plurality of pellets is contained. When a body is placed upon the plurality of pellets, as contained within the container, the location of each of the plurality of pellets will shift in the manner of a liquid into a position that provides a contoured support customized to the body.

These together with additional objects, features and advantages of the body pillow will be readily apparent to those of ordinary skill in the art upon reading the following detailed description of the presently preferred, but nonetheless illustrative, embodiments when taken in conjunction with the accompanying drawings.

In this respect, before explaining the current embodiments of the body pillow in detail, it is to be understood that the body pillow is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the body pillow.

It is therefore important that the claims be regarded as including such equivalent construction insofar as they do not depart from the spirit and scope of the body pillow. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
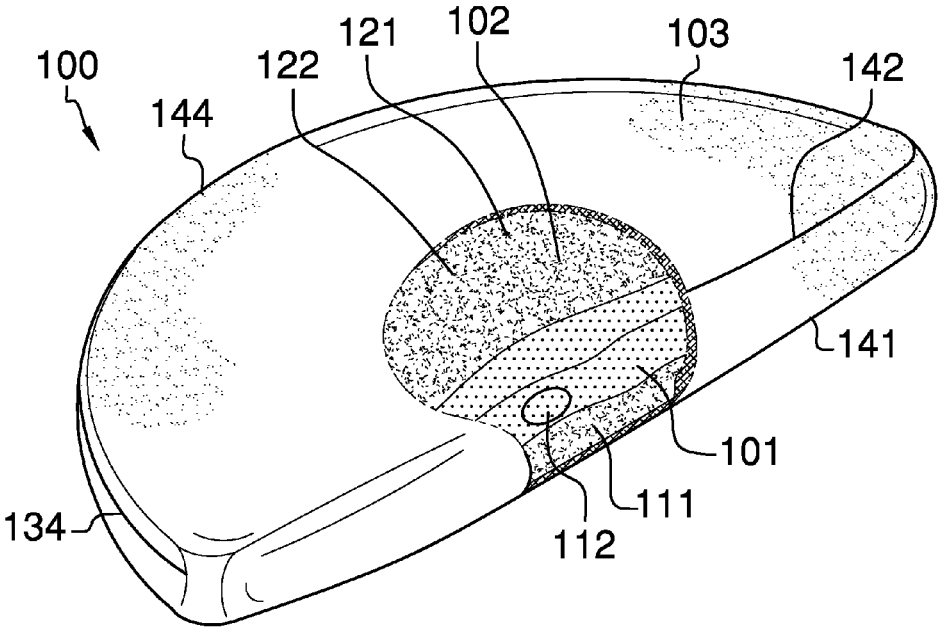
FIG. 1 is a perspective view of an embodiment of the disclosure.
Figure 2:
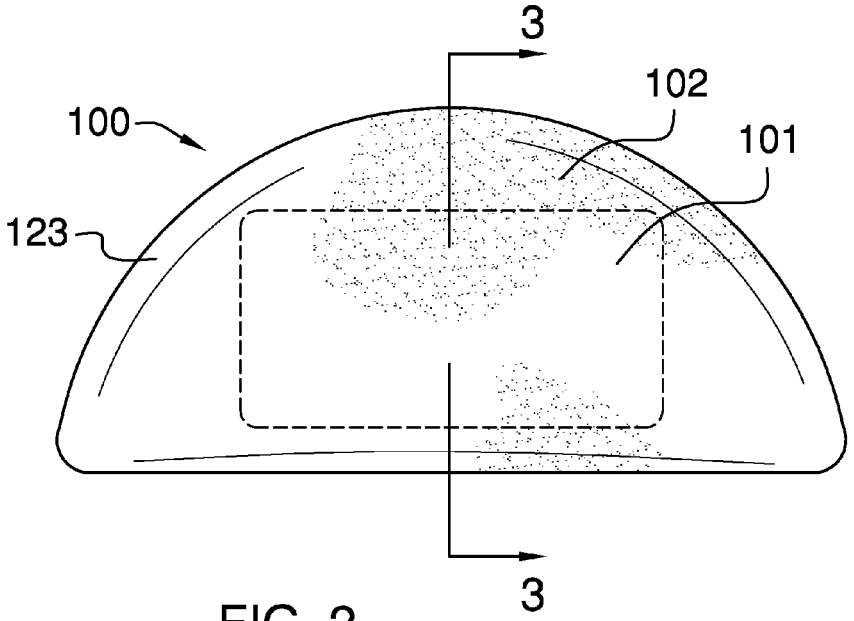
FIG. 2 is a top view of an embodiment of the disclosure.
Figure 3:
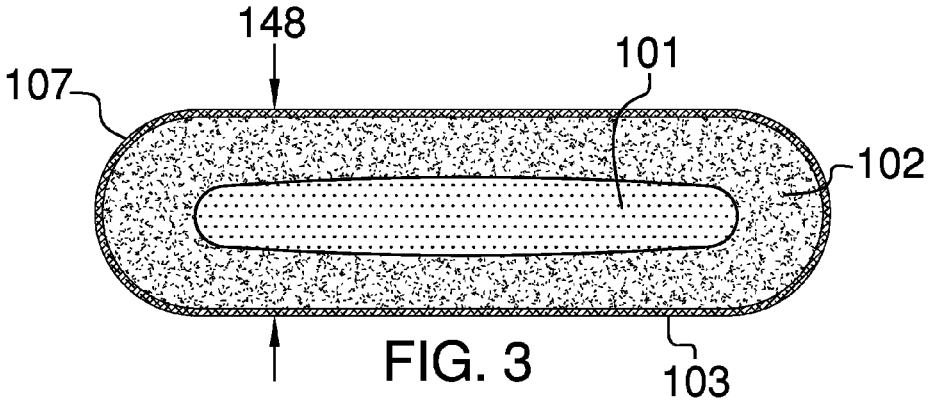
FIG. 3 is a cross-sectional view of an embodiment of the disclosure across 3-3 as shown in FIG. 2.
Figure 4:
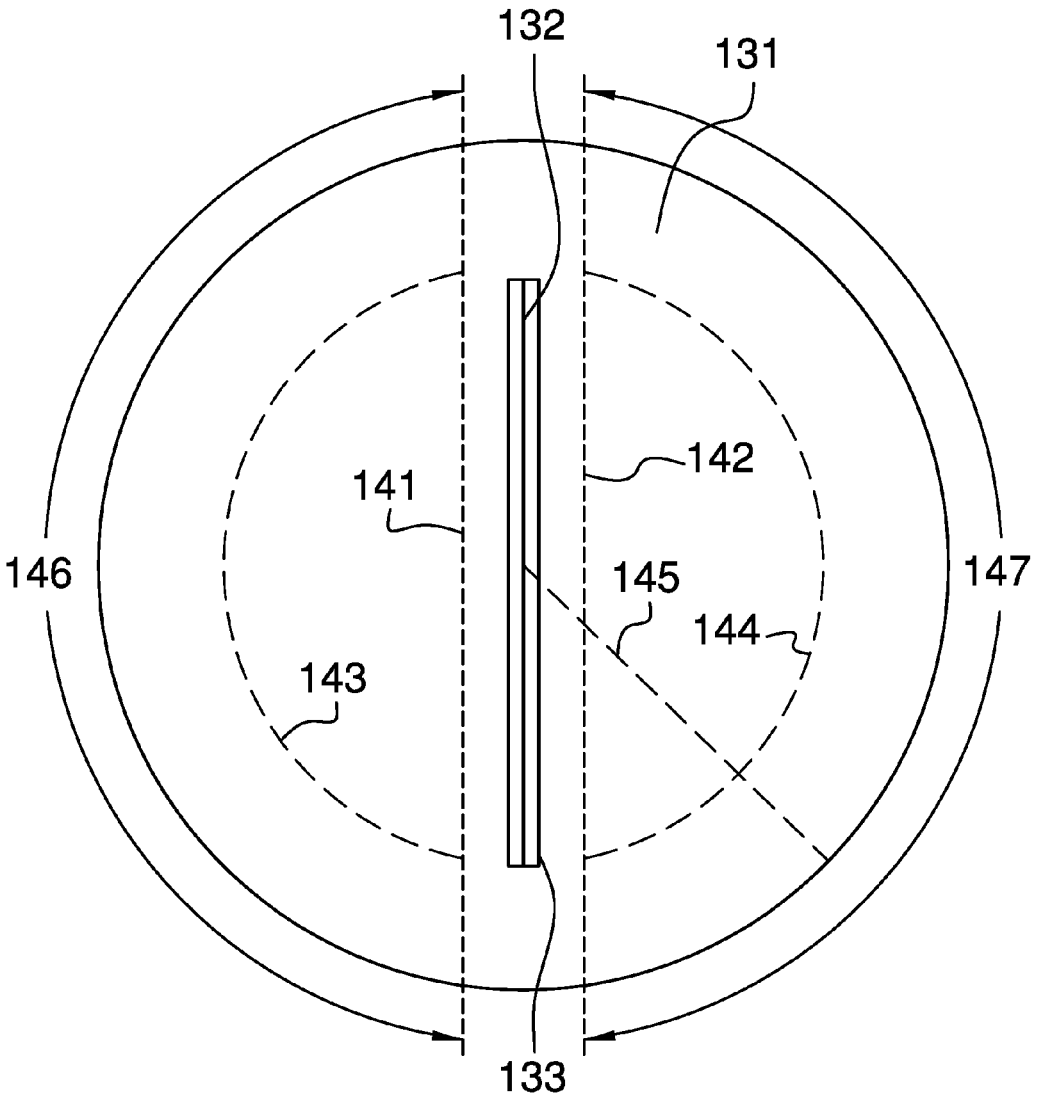
FIG. 4 is a detail view of an embodiment of the disclosure.

Detailed reference will now be made to one or more potential embodiments of the disclosure, which are illustrated in FIGS. 1 through 4.

The body pillow 100 (hereinafter invention) comprises a batting 101, a plurality of pellets 102, and a containment 103. The invention 100 is a pillow that is adapted to facilitate sleeping in a variety of positions. The batting 101 and the plurality of pellets 102 are contained within the containment 103. The batting 101 is formed from a first soft material 111 that provides the core cushioning structure of the invention 100. Each of the plurality of pellets 102 is made from a second soft material 122 that is formed in the structure of a pellet. The totality of the plurality of pellets 102 act very much like a liquid in the sense that, in their totality, the plurality of pellets 102 does not have a shape but instead takes the shape of the container within which the plurality of pellets 102 is contained. When a body is placed upon the plurality of pellets 102, as contained within the containment 103, the location of each of the plurality of pellets 102 will shift in the manner of a liquid into a position that provides a contoured support customized to the body.

The batting 101 comprises a wadding 112 formed from the first soft material 111. The batting 101 is the structure that provides the loft 148, or thickness, of the invention 100. The batting 101 provides both cushioning and the core structure of the invention 100. Suitable materials for the first soft material 111 include, but are not limited to, cotton fibers and readily commercially available polyester fiberfill. Cotton fibers are preferred.

The plurality of pellets 102 comprises a collection of individual pellets 121. Each individual pellet 121 is formed from a second soft material 122 in a shape that allows each individual pellet 121 to behave in an atomic or molecular fashion when each individual pellet 121 is accumulated into the plurality of pellets 102 and is contained within the containment 103 in the sense that the shape of each individual pellet 121 is formed in the shape necessary to allow the plurality of pellets 102 to take the shape of the containment 103 within which the plurality of pellets 102 are placed. Restating the previous sentence in a less formal manner: the shape of each individual pellet 121 may take any shape that does not interfere with the liquid like behavior of the plurality of pellets 102. Suitable materials for the second soft material 122 includes, but are not limited to, cotton fibers or polyurethane foam.

The containment 103 is a sheath which contains the batting 101 and the plurality of pellets 102. In the first potential embodiment of the disclosure, as shown most clearly in FIG. 4, the containment 103 comprises a sheeting 131 that is cut in a circular shape. The sheeting 131 further comprises a slit 132. The slit 132 is an aperture that is formed along the diameter of the circular shape. The slit 132 has attached to it a fastener 133. The fastener 133 is used to open and close the slit 132. The batting 101 and the plurality of pellets 102 are inserted into the containment 103 through the slit 132.

The sheeting 131 is further defined with a first fold 141, a second fold 142, a third fold 143, a fourth fold 144, a radius 145, a first arc 146 and a second arc 147. The radius 145 corresponds to the normal definition of the radius of a circle. The first fold 141 is a line along which the sheeting 131 will be folded. The first fold 141 is a line that is parallel to the slit 132. The second fold 142 is a line along which the sheeting 131 will be folded. The second fold 142 is a line that is parallel to the slit 132. The first arc 146 is the arc of the portion of the circumference of the sheeting 131 that runs from a first intersection of the first fold 141 and the circumference of the sheeting 131 to a second intersection of the first fold 141 and the circumference of the sheeting 131.

The first arc 146 is selected such that the first arc 146 subtends an angle of arc of less than 180 degrees. The second arc 147 is the arc of the portion of the circumference of the sheeting 131 that runs from a third intersection of the second fold 142 and the circumference of the sheeting 131 to a fourth intersection of the second fold 142 and the circumference of the sheeting 131. The second arc 147 selected such that the second arc 147 subtends an angle of arc of less than 180 degrees. The third fold 143 is a line along which the sheeting 131 will be folded. The third fold 143 is a circular arc that is centered on the same center point as the first arc 146 and that subtends the same angle of arc as the first arc 146. The fourth fold 144 is a line along which the sheeting 131 will be folded. The fourth fold 144 is a circular arc that is centered on the same center point as the second arc 147 and that subtends the same angle of arc as the second arc 147.

The containment 103 assembled by folding the sheeting 131 along the first fold 141, the second fold 142, the third fold 143 and the fourth fold 144 and attaching the first arc 146 to the second arc 147 with a seam 134.

In a first potential embodiment of the disclosure, the first soft material 111 is a mass of cotton fibers.

A second potential embodiment of the disclosure is identical to the first potential embodiment of the disclosure with the addition that the second soft material 122 is formed from cotton fibers. In addition, each individual pellet 121 is formed in a spherical shape.

A third potential embodiment of the disclosure is identical to the first potential embodiment of the disclosure with the addition that the second soft material 122 is formed from a polyurethane foam. In addition, each individual pellet 121 is formed in the shape of a rectangular block.

A fourth potential embodiment of the disclosure is identical to the second potential embodiment of the disclosure with the addition that the sheeting 131 of the containment 103 further comprises a readily and commercially available textile and the fastener 133 is selected from the group consisting of a hook and loop fastener or a zipper.

A fifth potential embodiment of the disclosure is identical to the third potential embodiment of the disclosure with the addition that the sheeting 131 of the containment 103 further comprises a readily and commerically available textile and the fastener 133 is selected from the group consisting of a hook and loop fastener or a zipper.

A sixth potential embodiment of the disclosure is identical to the first potential embodiment of the disclosure with the addition that the first fold 141, the second fold 142, the third fold 143, and the fourth 144 are selected such: 1) the span from the circumference to the third fold 143 equals the span from the circumference to the fourth fold; 2) the span from the seam 134 to the third fold 143 is greater than or equal to one quarter of the span of the radius 145; and, 3) the span from the seam 134 to the third fold 143 is lesser than or equal to one half the span of the radius 145.

The invention 100 is used as any normal pillow or cushion.

The following definitions were used in this disclosure:

Correspond: As used in this disclosure, the term correspond means that a first object is in some manner linked to a second object in a one to one fashion.

Cushion: As used in this disclosure a cushion is a pad or pillow formed from soft material that is used for resting, sleeping, or reclining.

Diameter: As used in this disclosure, a diameter of an object is a straight-line segment that passes through the center of an object. The line segment of the diameter is terminated at the perimeter or boundary of the object through which the line segment of the diameter runs.

Fastener: As used in this disclosure, a fastener is a device that is used to join or affix two objects. Fasteners generally comprise a first element, which is attached to the first object and a second element, which is attached to the second object such that the first element and the second element join to affix the first object and the second object.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook or loop surface" with the understanding that when the two objects are fastened together one of the two objects will have a hook surface and the remaining object will have the loop surface.

Perimeter: As used in this disclosure, a perimeter is one or more curved or straight lines that bounds an enclosed area on a plane or surface. The perimeter of a circle is commonly referred to as a circumference.

Seam: As used in this disclosure, a seam is a joining of: 1) a first textile to a second textile; 2) a first sheeting to a second sheeting; or, 3) a first textile to a first sheeting.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheath: As used in this disclosure, a sheath is a flexible material that is used to cover an object.

Sheeting: As used in this disclosure, sheeting is a material, such as a textile, leather, or plastic, in the form of a thin flexible layer or layers.

Textile: As used in. this disclosure, a textile material that is woven, knitted, braided or felted. Synonyms in common usage for this definition include fabric and cloth.

Zipper: As used in this disclosure, a zipper is a fastening device comprising two flexible strips with interlocking components that are opened and closed by pulling a slide along the two flexible strips.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A domestic article comprising
a batting, a plurality of pellets, and a containment;
wherein the domestic article is adapted for use as bedding;
wherein the domestic article is adapted for use during sleep;
wherein the batting and the plurality of pellets are contained within the containment;
wherein the batting comprises a wadding formed from a first material;
wherein the batting creates a loft of the domestic article;
wherein the first material is selected from the group consisting of cotton fibers or polyester fiberfill;
wherein the plurality of pellets comprises a collection of individual pellets;
wherein each individual pellet is formed from a second material;
wherein the second material is selected from the group consisting of cotton fibers or polyurethane foam;
wherein the containment is a sheath;
wherein the containment contains the batting and the plurality of pellets;
wherein the containment comprises a sheeting that is cut in a circular shape;
wherein the sheeting is further defined with a first fold, a second fold, a third fold, a fourth fold, a radius, a first arc and a second arc;
wherein the sheeting further comprises a slit;
wherein the slit is an aperture that is formed along a diameter of the circular shape;
wherein the slit has attached to it a fastener;
wherein the fastener is used to open and close the slit;
wherein the batting and the plurality of pellets are inserted into the containment through the slit;
wherein the first fold is a line along which the sheeting is folded;
wherein the first fold is parallel to the slit;
wherein the second fold is a line along which the sheeting is folded;
wherein the second fold is parallel to the slit;
wherein the first arc is the arc of the portion of a circumference of the sheeting that runs from a first intersection of the first fold and the circumference of the sheeting to a second intersection of the first fold and the circumference of the sheeting;
wherein the second arc is the arc of the portion of the circumference of the sheeting that runs from a third intersection of the second fold and the circumference of the sheeting to a fourth intersection of the second fold and the circumference of the sheeting;
wherein the second arc selected such that the second arc subtends an angle of arc of less than degrees;
wherein the third fold is a line along which the sheeting will be folded;
wherein the third fold is a circular arc that is centered on the same center point as the first arc and that subtends the same angle of arc as the first arc;
wherein the fourth fold is a line along which the sheeting will be folded;
wherein the fourth fold is a circular arc that is centered on the same center point as the second arc and that subtends the same angle of arc as the second arc;
wherein the first arc is attached to the second arc with a seam.

2. The domestic article according to claim 1 wherein the first material is a mass of cotton fibers.

3. The domestic article according to claim 2
wherein the second material is formed from cotton fibers;
wherein each individual pellet is formed in a spherical shape.

4. The domestic article according to claim 3
wherein the sheeting further comprises a textile;
wherein the fastener is selected from the group consisting of a hook and loop fastener or a zipper.

5. The domestic article according to claim 2
wherein the second material is formed from a polyurethane foam;
wherein each individual pellet is formed in the shape of a rectangular block.

6. The domestic article according to claim 5
wherein the sheeting further comprises a textile;
wherein the fastener is selected from the group consisting of a hook and loop fastener or a zipper.

7. The domestic article according to claim 1
wherein a span from the circumference to the third fold equals the span from the circumference to the fourth fold;
wherein the span from the seam to the third fold is greater than or equal to one quarter of the span of the radius;
wherein the span from the seam to the third fold is lesser than or equal to one half the span of the radius.

8. The domestic article according to claim 7
wherein the second material is formed from cotton fibers;
wherein each individual pellet is formed in a spherical shape;

wherein the sheeting further comprises a textile;

wherein the fastener is selected from the group consisting of a hook and loop fastener or a zipper.

9. The domestic article according to claim 7 wherein the second material is formed from a polyurethane foam;

wherein each individual pellet is formed in the shape of a rectangular block;

wherein the sheeting further comprises a textile;

wherein the fastener is selected from the group consisting of a hook and loop fastener or a zipper.

* * * * *